United States Patent [19]

Tornero

[11] Patent Number: 4,749,230

[45] Date of Patent: Jun. 7, 1988

[54] HEIGHT ADJUSTING DEVICE FOR CHAIR BACKREST

[76] Inventor: Lino E. Tornero, 809 Quailmeadow La., Colfax, N.C. 27235

[21] Appl. No.: 41,549

[22] Filed: Apr. 23, 1987

[51] Int. Cl.[4] ..... A47C 3/00

[52] U.S. Cl. ..... 297/353; 297/356; 298/244; 298/297.3

[58] Field of Search ..... 297/353, 410, 356; 248/407, 244, 297.3

[56] References Cited

U.S. PATENT DOCUMENTS

| | | | |
|---|---|---|---|
| 979,149 | 12/1910 | Gay | 297/356 |
| 1,210,199 | 12/1916 | Passeck | 248/244 |
| 1,400,960 | 12/1921 | Lambert | 248/244 |
| 1,569,708 | 1/1926 | Burns et al. | 248/297.3 X |
| 2,256,856 | 9/1941 | Zwald | 248/297.3 X |
| 2,830,653 | 4/1958 | Gaugler | 297/356 X |
| 3,162,416 | 12/1964 | Amarillas | 248/244 |
| 4,043,592 | 8/1977 | Fries | 297/353 X |
| 4,451,084 | 5/1984 | Seeley | 248/297.3 X |
| 4,639,039 | 1/1987 | Donovan | 248/297.3 X |
| 4,660,885 | 4/1987 | Suhur et al. | 297/353 |

FOREIGN PATENT DOCUMENTS

| | | | |
|---|---|---|---|
| 247821 | 4/1911 | Fed. Rep. of Germany | 297/410 |
| 636573 | 5/1950 | United Kingdom | 248/297.3 |

*Primary Examiner*—Peter A. Aschenbrenner

[57] ABSTRACT

A height adjusting device for manually locating and automatically locking a chair backrest at a desired vertical position relative to the chair seat. The device comprises two guided and slidably interlocking plates and one lock pin. Optionally, one plate may itself be the backrest support or "J" bar. One plate is mounted on the chair backrest and one plate is mounted on the "J" bar or support frame and engaged so as to slide one relative to the other. The lock pin is free to move within the slotted track of one plate and forced therewith from one locked position to a standby position or to an unlocked position by the cam action of any of a plurality of notches and inclined surfaces of a slotted cam contained on the other plate. The device is characterized by the absence of springs or other supplementary biasing means and by virtue of its simplicity it is highly reliable and economical to manufacture.

14 Claims, 4 Drawing Sheets

88
85
87
84
107
106
105
104
102
83
103
86
108
74
75
82
80
89
76
119
77
115
101
91
78
79
110
109
99
81
100
75b
52

HEIGHT ADJUSTING DEVICE FOR CHAIR BACKREST

BACKGROUND AND SUMMARY OF THE INVENTION

The present invention relates in general to devices which provide for the selective adjustment and positioning of components relative to one another.

In particular, it relates to the vertical adjustment of a chair backrest relative to the chair seat such that the backrest can be manually raised or lowered to any of a plurality of selectable positions and releasably locked therein.

As will be seen, the device is also ideally suited for other purposes, such as shelves and windows due to its simplicity and economy in manufacture.

In the prior art, chair backrest height adjustment has been accomplished in some chairs by the use of operabale screws that secure a slidably adjustable backrest on an upwardly extending J-bar which is part of the chair frame. In other chairs, manually operable rack and pinion types or linear ratchets with spring biased locking arms and pins provide for backrest adjustment. Such prior devices are complex in contruction, requiring precise construction, injection molded parts and springs, and are therefore costly to manufacture, trouble prone, unreliable and visually unattractive.

The device and object of the present invention provides for the manual vertical adjustment of a chair backrest relative to the chair seat at any of a plurality of releasably lockable positions within a predetermined range. As will appear clear in the subsequent specification, the device is, due to its inherent simplicity, highly suitable for adaptation to other height adjusting purposes, such as in shelves, windows and other items requiring reliable and economical means. In a chair, the device comprises a slide plate which is rigidly secured to the chair frame or J-bar and a track plate which is rigidly secured to the backrest and slidably mounted for vertical movement on the slide plate. The slide plate and track plate are slidably coupled to each other by tongue and groove connection means along their vertical edges. Both the slide plate and the track plate are provided with slots exhibiting cam surfaces. The slide plate slot exhibits a cam surface so designed as to provide at least three distinct positions for the lock pin, these being: a first unlocked position, a second standby position, a third locked position; the lock pin being free to slide and roll along the slot cam surface of the slide plate in response to the action of the cam surfaces of the track plate slot. The track plate slot exhibits cam surfaces such that on one side the cam surface comprises a series of notches made to include a corresponding series of incline plane cam surfaces so that upward vertical displacement of the slide plate relative to the track plate causes the lock pin to roll along the incline plane surface of a notch with a resultant lateral displacement onto the standby position on the cam surface of the slide plate slot. As the notch passes over center of the lock pin, the next notch is aligned with a portion of the slide plate slot so that the lock pin is free to occupy the notch. At this point, downward movement of the track plate relative to the slide plate is not possible and the device is in the locked position. Continuous vertical adjustment in the upward direction is possible for as many positions as notches are provided on the track plate slot. The last notch is provided with an extended incline plane cam surface so as to guide the lock pin and cause it to roll onto the unlocked position on the cam surface of the slide plate slot, whereupon the track plate is free to vertically slide in the downward direction. As the track plate reaches its lowermost vertical position, a cam surface on the track plate slot, at the upper end of the slot, causes the lock pin to freely roll from the unlocked position to the locked position corresponding to the first notch on the track plate slot and the cycle may be repeated at will.

The advantages of the device are numerous. The device is extremely easy to operate as all that is required is to lift the backrest of the chair only slightly to the next locked position and locking takes place automatically upon release of the backrest. Intrinsic to the design of the device is a high degree of reliability as it does not make use of springs or other biasing means prone to failure and relies only on cam action and gravity for positioning of the lock pin. Therefore the device is extremely economical to manufacture as the number of parts is only a maximum of three and the need for complex injection molded parts is eliminated. Furthermore, the device is highly suitable for manufacture by metal stamping and forming techniques. Because of the simplicity of the device it is also possible and highly desirable to make the slide plate, which contains only a short cam slot, be the J-bar itself, thus eliminating yet another part and providing the entire assembly with a very low profile; a highly desirable feature for chair manufacturers and designers. Further yet the device may be provided with any plurality of locking pins and the slide plate with any plurality of cam slots so as to obtain different positional strokes of one plate relative to the other, or to provide for added locking elements. The economical means of manufacture provided by the device, object of the present invention, make it ideally suited for providing reliable means of vertical adjustment to items where cost has thus far prevented their use or where an easily operable device is imperative. One such item may be all type of shelving, where it is often desirable to adjust the shelf height with facility and ease. Such shelving may be of the type required in household ovens, refrigerators, and casegoods. In addition the device is ideally suited for the reliable, safe and economical adjustment of windows, as opposed to the present art use of troublesome and unpredictable friction devices.

BRIEF DESCRIPTION OF DRAWINGS

In order to better understand the features of the invention the following drawings have been provided:

FIG. 13 is an exploded view of the device modified for use in the adjustment of shelves and the like.

FIG. 14 is a view of the device of FIG. 13 to show an alternative configuration for the adjustment of shelves and the like.

FIG. 15 is a top view of the device of FIG. 14.

FIG. 16 is a top view of the device of FIG. 13.

DESCRIPTION

Figure 1:
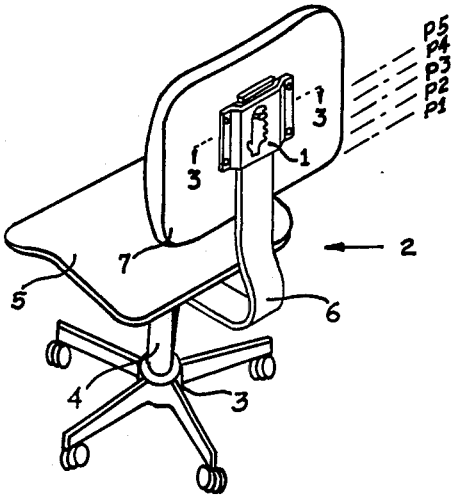
FIG. 1 is a three dimensional representation of a chair equipped with the device object of the invention.

The object of the invention can be achieved in an advantageous manner by the arrangement of elements shown in the accompanying drawings of which the following are detailed descriptions:

Referring to FIG. 1, the height adjusting device and object of the invention (hereinafter called "the device") 1 is seen installed on a chair 2. The chair 2, comprises a supporting base 3, into which is located a pedestal 4. A seat 5, is located on and supported by an undercarriage (not shown) to which is attached a J-bar 6 for support of a backrest 7 by means of the device 1. The device 1 provides for manually locating and releasably locking the backrest 7 in any of a plurality of vertical positions P1, P2, P3, P4, and P5. Most chair designs call for a small number of said vertical backrest positions and it is understood that the device 1 may provide any arbitrary number of releasably locking positions for backrest 7.

Figure 2:
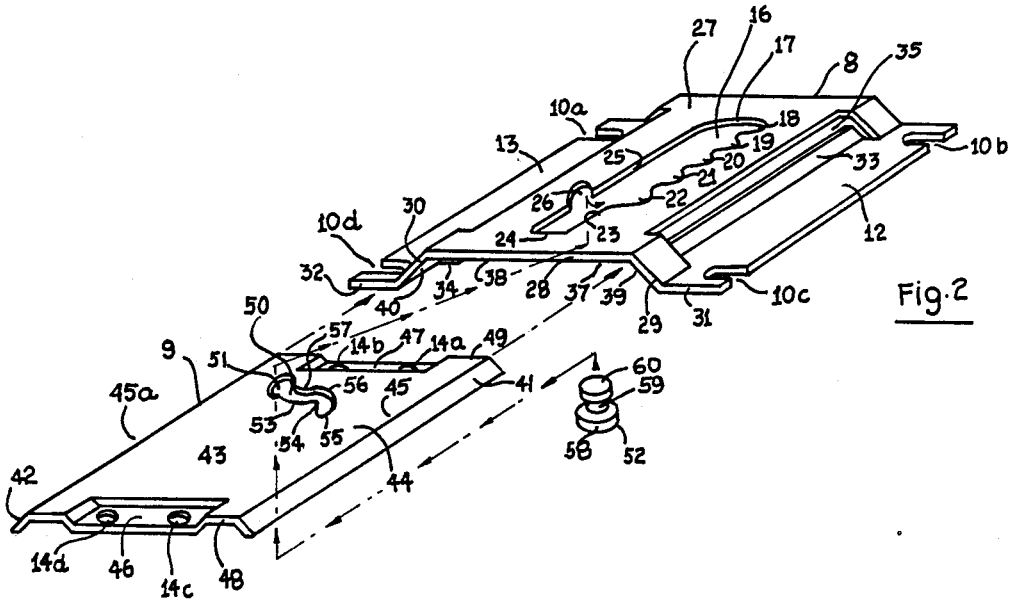
FIG. 2 is an exploded view of the device of FIG. 1 and includes a track plate, a slide plate, and a lock pin.
Figure 3:
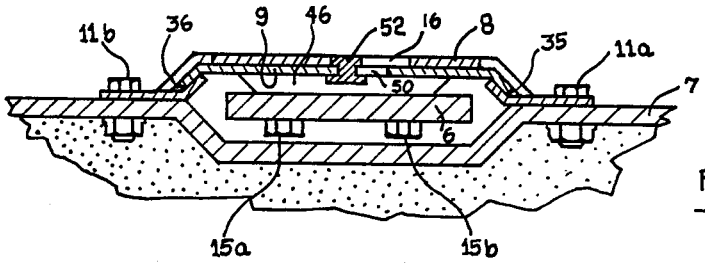
FIG. 3 is a top view and partial cross section of the device of FIG. 1 taken on line 3—3.
Figure 5:
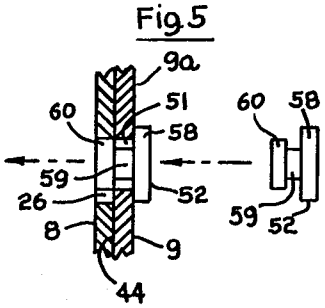
FIG. 5 is a cross sectional view of a portion of the device in FIG. 1 taken on line 4—4 to show the initial location of the lock pin.

Referring now to FIGS. 1, 2 and 3, the device 1 is seen in an exploded view and comprises a track plate 8 rigidly secured to the backrest 7 by means of notches 10*a*, 10*b*, 10*c*, 10*d* and bolts 11*a* and 11*b* (11*c* and 11*d* are not shown) on its vertical sides 12 and 13, and a slide plate 9 rigidly secured to the J-bar 6 by means of holes 14*a*, 14*b*, 14*c*, 14*d* and bolts 15*a* and 15*b* (15*c* and 15*d* are not shown) and coupled for vertical movement on track plate 8. Track plate 8 comprises a slot 16 on external surface 27, defining a first cam surface 17, a series of notches 18 through 22, a second cam surface 23, a horizontal straight section 24, a vertical straight section 25 opposite notches 18 through 22 and cam surface 23, and a keying notch 26 near the lowermost portion of straight section 25. Track plate 8 is preferably made of stamped metal for ease, speed and economy of construction, and is made so as to define an external surface 27, on a flat section 28. From the vertical sides of section 28 there extends angled sections 29 and 30 and flat vertical sections 31 and 32. Sections 31 and 32 are provided with notches 10*a*, 10*b*, 10*c*, 10*d* for installation of bolts 11*a*, 11*b* (11*c*, 11*d* not shown). Tongues 33 and 34 are stamp formed by material displaced partly from flat section 28 and partly from angled sections 29 and 30 yet remaining a part of flat sections 31 and 32 and defining tracks 35 and 36 on the vertical sides of the cavity 37 defined by the internal surfaces 38 of flat section 28 and the internal surfaces 39 and 40 of angled sections 29 and 30. Tracks 35 and 36 are so designed as to accept in slidable vertical engagement tongues 41 and 42 of slide plate 9 and yet substantially prevent lateral displacement of plate 9 and also substantially prevent displacement of slide plate 9 in a direction perpendicular to section 28 of track plate 8, while also maintaining substantially close proximity between the internal surface 38 of track plate 8 and the external surface 44 of slide plate 9. Slide plate 9 is designed as a mating part for slidable engagement on the tracks 35 and 36 and within the cavity 37 of track plate 8, and it exhibits tongues 41 and 42 disposed at an angle to surface 44 and extending along the vertical sides 45 and 45*a* of slide plate 9. Thus tongues 41 and 42 of slide plate 9 can slidably engage tracks 35 and 36 of track plate 8 for substantially unrestricted vertical movement of slide plate 9 relative to track plate 8. Slide plate 9 is provided with stamped depressions 46 and 47 formed respectively on the horizontal sides 48 and 49 and extending for an arbitrary distance and at a suitable depth to provide space for installation of bolts 15*a*, 15*b*, 15*c*, 15*d* without interference with the internal surface 38 of track plate 8. Depressions 46 and 47 are each provided with tapped holes 14*a*, 14*b*, 14*c*, 14*d* to receive bolts 15*a*, 15*b*, 15*c*, 15*d* and provide solid attachment of slide plate 9 to J-bar 6. Slide plate 9 exhibits a slot 50 which defines a notch 51 located so as to closely match or align with notch 26 of track plate 8 as slide plate 8 is made to slide into tracks 35 and 36 of track plate 8 for initial assembly of lock pin 52. Slot 50 also defines a series of cam surfaces 53, 54, 55, 56, 57, which will be subsequently described. Latch pin 52, preferably made by machining means, exhibits a cylindrical flange 58 of suitable thickness to prevent interference with J-bar 6, an intermediate cylindrical transition zone 59 of a diameter substantially less than the diameter of flange 58 and only slightly less than the average width of slot 50 in slide plate 9 with a thickness only slightly larger than the thickness of slide plate section 43, and a cylindrical flange 60 with a diameter only slightly smaller than the diameter of notches 51 and 26 yet substantially larger than the diameter of transition zone 59 and of a thickness at least equal the 10 thickness of track plate flat section 28. FIGS. 3 and 5 show cutaway views of the relative engagement of lock pin 52 between track plate 8 and slide plate 9.

Figure 11:
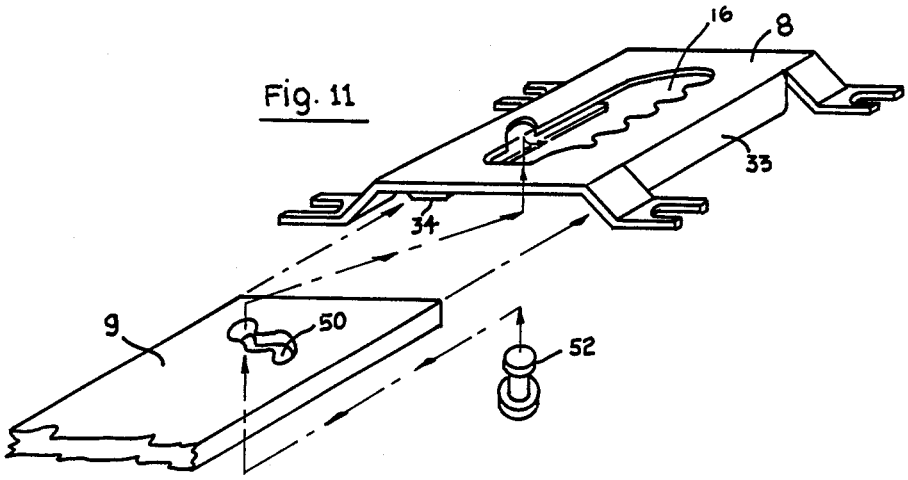
FIG. 11 is a three dimensional representation of the device in FIG. 1 to show substitution of the slide plate by the "J" bar of the chair.
Figure 12:
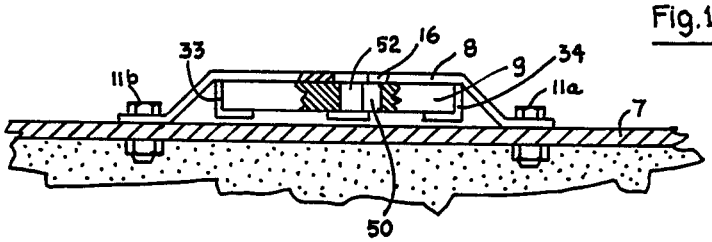
FIG. 12 is a top view and partial cross section at line 11—11 of the device of FIG. 11.

Referring now to FIGS. 11 and 12, the device 1, of FIGS. 1 thru 12, is seen in a modified arrangement permitting the reduction of the number of parts making up the device while providing for a much shallower configuration, both highly desirable features. Here, slide plate 9 is the J-bar 6 itself, and tongues 33 and 34 are modified to accept the J-bar in vertical sliding engagement relative to the track plate 8 in the manner previously described for slide plate 9.

Figure 7:
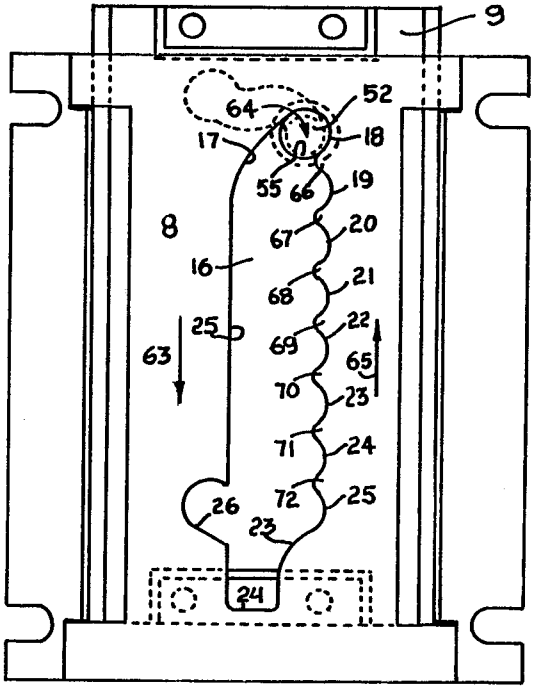
FIG. 7 is a plan view of the device of FIG. 1 to show a first locked position and relative location of the device elements.
Figure 10:
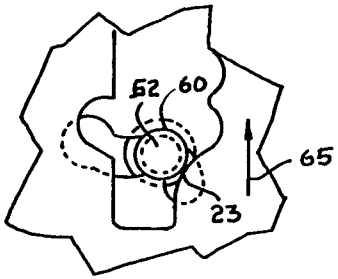
FIG. 10 is a partial plan view of the device in FIG. 1 to show the action of the cam surface forcing the lock pin to a third unlocked position.
Figure 9:
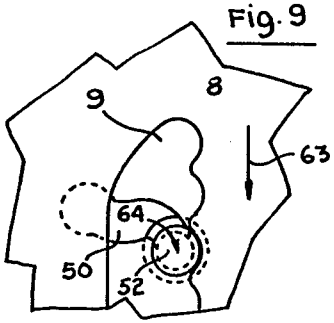
FIG. 9 is a partial plan view of the device in FIG. 1 to show yet another locked position and location of the lock pin.
Figure 6:
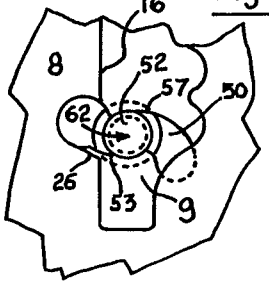
FIG. 6 is a partial plan view of the device in FIG. 1 to show a step in the location of the lock pin.
Figure 8:
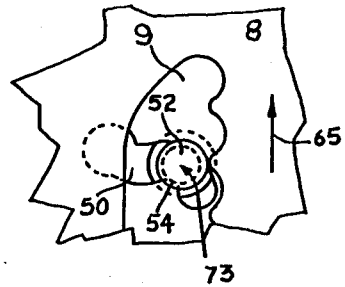
FIG. 8 is a partial plan view of the device in FIG. 1 to show a second standby position and momentary location of the lock pin.
Figure 4:
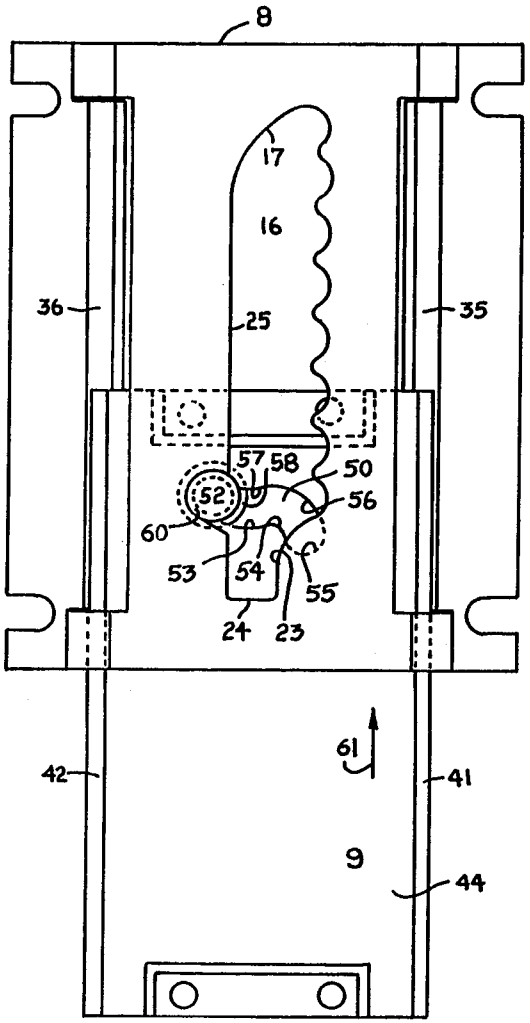
FIG. 4 is a plan view of the device of FIG. 1.

Referring to FIGS. 4 and 5, the device 1 is shown in a plan view during initial assembly. Slide plate 9 is made to vertically slide in the direction of the arrow 61 and into the cavity 37 of track plate 8 in such manner as to insure the engagement of tongues 41 and 42 with tracks 35 and 36 and that notch 51 of slide plate 9 is made to coincide with notch 26 of track plate 8. Thus the flange 60 of lock pin 52 can be made to slidably enter notches 26 and 51 in a manner perpendicular to track plate 8 and slide plate 9 until contact is established between the flange 58 of lock pin 52 and the internal surface 9a of track plate 8. Referring to FIG. 6, thereafter lock pin 52 is made to slide or rotate to a first unlocked position 62. At this point the transition zone 59 of lock pin 52 is slidably tangent to the cam surfaces 53 and 57 defined by slot 50, while flange 60 of lock pin 52 is abutted against the external surface 44 of slide plate 9. In this manner lock pin 52 is trapped within the slot 50 of slide plate 9 yet substantially free to displace within slot 50 and is prevented from perpendicular displacement relative to the flat section 44 of slide plate 9. Referring now to FIG. 7, vertical downward displacement of track plate 8 in the direction of arrow 63 will cause cam surface 17 of slot 16 in track plate 8 to come in contact with and laterally displace lock pin 52 to a locked position 64. Said locked position is cooperatively formed by cam surface 55 of slide plate 9 and one first notch 18 of track plate 8. Referring now also to FIG. 8, should the track plate 8 and consequently backrest 7 be vertically and upwardly (in the direction shown by arrow 65) displaced for a small but sufficient distance, lock pin 52 will be slidably displaced and guided over cam surface 54 of slot 50 by the action of a protruding portion 66–72 of notches 18–25 to a momentary standby position 73. Additional vertical and upward displacement of the track plate 8 in the direction shown by arrow 65 will immediately cause lock pin 52 to again slide into the aforementioned locked position 64. Referring also to FIG. 9, should the track plate 8 (and backrest 7) be allowed to vertically and downwardly displace, the lock pin 52 will be firmly seated in said lock position 64. Every time the lock pin is made to achieve a next locked position, track plate 8, and consequently backrest 7, will be upwardly and vertically displaced, and the device will be locked at a higher height. Continual displacement of the track plate 8 in a vertical and upward direction shown by arrow 65 will repeat this process causing lock pin 52 to go from one selectable locked position 64 to a standby position 73 and back again to locked position 64. The process can be repeated until flange 60 of lock pin 52 comes in contact with and is lateraly guided by the action of cam surface 23 of track plate 8 (refer to FIG. 10) to the unlocked position 62, as shown in FIG. 6.

Figures 13, 14, 15, 16:
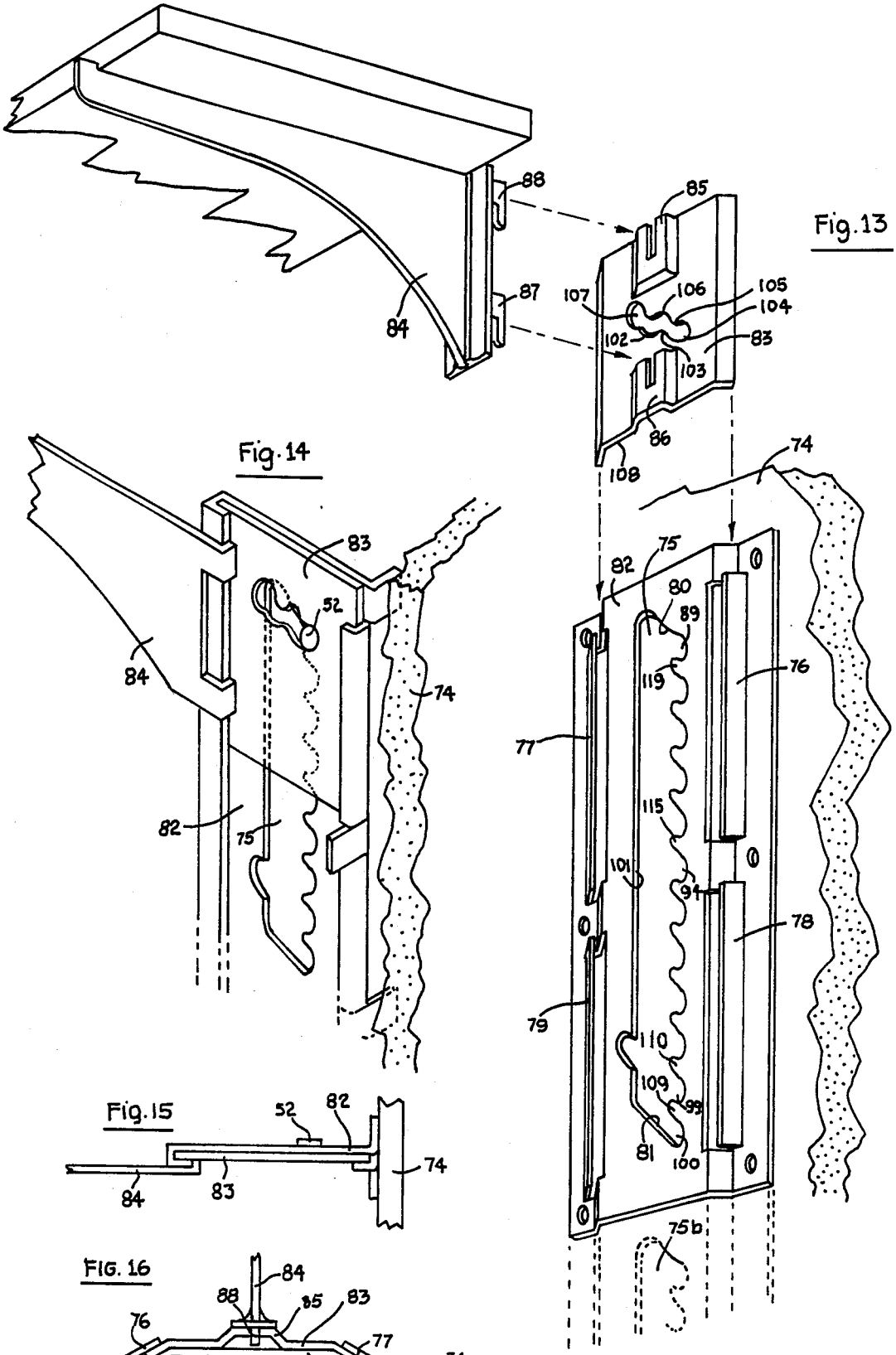

Referring now to FIGS. 13 and 14, the device of FIGS. 1 thru 12 is seen here in a modified arrangement of its elements to facilitate its adaptation to items such as shelving. Here, track plate 82 is made stationary relative to slide plate 83 and solidly mounted onto a wall or other suitable support structure 74, while slide 83 is mounted on track plate 82 in such a manner that slide plate 83 is slidably and releasably lockable relative to track plate 82 in any of a number of selectable locking positions. To this end, track plate 82 is provided with a plurality of modified cam slots 75, 75b and modified tongues 76, 77, 78, 79. Slot 75 is modified in such a manner that, referring to the device of FIG. 2, cam surfaces 17 and 23 are reversed in position relative to notches 18, 19, 20, 21, 22 and straight surface 25, thus, referring to FIG. 13 and 14, cam surface 80 of slot 75 will cause lock pin 52 to displace to an unlocked position while cam surface 81 will cause the lock pin 52 to displace to a locked position. Track plate 82 can be provided with any number of such slots 75 so as to provide for any number of adjustable brackets 84. Slide plate 83 is provided with a number of suitably configured interlocking elements 85 and 86 so as to mount brackets 84 with interlocking elements 87 and 88. FIG. 16 shows the device of FIG. 13 on a top view describing the arrangement of its elements. Referring now to FIG. 14, the device is seen in yet another configuration designed so as to provide mounting of the device of FIG. 13 in a manner perpendicular to support structure 74 and bracket 84 may be formed integral to slide plate 83. FIG. 16 is a top view of the device of FIG. 14 showing arrangement of its elements.

Operation of the devices in FIGS. 13 and 14 is analogous to that of the device in FIG. 2; slide plate 83 is capable of slidable and releasably lockable movement relative to track plate 82 in an arbitrary number of positions.

It is to be understood that the device 1 is not limited to use in chairs, it being also ideally adaptable for use on adjustable shelving, windows and in general any item where it is desirable to provide for slidable, releasably and lockable displacement of one member relative to another member. It will be apparent that many useful modifications of the device are possible, without departing from the fundamental basis of the invention.

I claim:

1. A device for positionally adjusting and releasably locking a chair backrest in any of a plurality of positions on a seat support comprising:

a. a slide plate which is rigidly secured to the support;

b. a track plate which is rigidly secured to the chair backrest for sliding movement between two extreme positions, said slide plate slidably received by said track plate;

c. locking means for releasably locking said track plate to said slide plate, said locking means comprising:

a track plate slot, said slot having a plurality of notches on one side, a sinuous slide plate slot, said slide plate slot having a plurality of cam surfaces, a lock pin, said lock pin engaged within said sinuous slot, said lock pin being responsive to displacement of said track plate relative to said slide plate and being releasably engageable with said track plate notches.

2. A device according to claim 1 wherein said slide plate and said track plate comprise interengaging means for slidably mounting said track plate on said slide plate.

3. A device according to claim 2 wherein said track plate slot and said slide plate slot coincide by movement of said slide plate relative to said track plate to allow said lock pin to move perpendicularly to said track plate and said slide plate for removal of said lock pin.

4. A device according to claim 2 wherein said lock pin has a transition zone for engagement with said slide plate slot.

5. A device according to claim 2 wherein said lock pin has a pair of end flanges, one of said end flanges having a diameter greater than the other.

6. A device according to claim 2 wherein said slide plate contains a plurality of slots.

7. A device according to claim 2 wherein said slide plate is J-shaped.

8. A device for releasably locking a structural member in any of a plurality of positions relative to a support structure comprising:

a. a slide plate which is rigidly secured to the structural member and which is mounted for sliding movement between two extreme positions, b. a track plate which is rigidly secured to the support structure, said slide plate slidably received by said track plate, c. locking means for releasably locking said track plate and said slide plate in positions responsive to manual movement of said slide plate, said locking means comprising:

(1) a track plate slot, said slot having a plurality of notches along one side, (2) a sinuous slide plate slot, (3) a lock pin, said pin within said slide plate slot, said lock pin being responsive to displacement of said slide plate relative to said back plate to a locked position within a first notch on said track plate slot and said lock pin being movable to an unlocked position by further displacement of said slide plate relative to said track plate.

9. A device according to claim 8 wherein said slide plate and said track plate are perpendicularly mounted relative to the support structure.

10. A device according to claim 8 wherein said track plate is provided with a plurality of cam surfaces along said track plate slot.

11. A releasably positionable device for providing adjustable movement between two structures comprising: a slide plate, a track plate, said slide plate slidably received by said track plate, said track plate including a slot having a plurality of notches along one side thereof, said slide plate having a sinuous slot with a cam surface therealong, said track plate slot transversely aligned with said slide plate slot, a rotatable lock pin, said pin positioned within said track plate slot and said slide plate slot whereby movement of said slide plate relative to said track plate will urge said pin from a locked position within one of said notches along said cam surface of said sinuous slot to a standby position out of said notch.

12. A releasably positionable device as claimed in claim 11 wherein said track plate slot includes a pin removal notch.

13. A releasably positionable device as claimed in claim 11 wherein said slide plate slot is laterally positioned relative to said track plate slot.

14. A releasably positionable device as claimed in claim 12 wherein one end of said sinuous slot coincides with said track plate notches.

* * * * *